United States Patent [19]

Ancker

[11] 4,096,651

[45] Jun. 27, 1978

[54] SKI BOOT

[76] Inventor: Per Ancker, Vändstigen 4, S-181-42 Lidingö, Sweden

[21] Appl. No.: 714,119

[22] Filed: Aug. 13, 1976

[30] Foreign Application Priority Data

Aug. 22, 1975 Sweden ..... 7509358

[51] Int. Cl.[2] ..... A43B 5/04

[52] U.S. Cl. ..... 36/120

[58] Field of Search ..... 36/99, 117, 118, 119, 36/120, 121

[56] References Cited

U.S. PATENT DOCUMENTS

| | | | |
|---|---|---|---|
| 3,303,584 | 2/1967 | Werner | 36/120 |
| 3,396,479 | 8/1968 | Primak | 36/117 |
| 3,543,421 | 2/1969 | Ader | 36/121 |
| 3,718,995 | 3/1973 | Graup | 36/121 |
| 3,744,161 | 7/1973 | Herunter | 36/117 |
| 3,953,930 | 5/1976 | Ramer | 36/117 |

FOREIGN PATENT DOCUMENTS

| | | | |
|---|---|---|---|
| 2,203,772 | 8/1972 | Germany | 36/121 |

*Primary Examiner*—Patrick D. Lawson

[57] ABSTRACT

A ski boot for downhill skiing is provided comprising an inner shell, a sole and an outer environment and climate shield. The inner shell, which constitutes the foot support, consists of an upper and a lower part from a stiff material with a mutual joint between both these parts. The environment and climate shield consists of a soft material which can be folded down to expose the inner shell.

10 Claims, 4 Drawing Figures

SKI BOOT

The present invention relates to a ski boot, especially for downhill skiing, consisting of an inner shell, a sole and an outer environment and climate shield.

At present, nearly all ski boots are made from plastic and this means amongst other things that the boot when it is warmed up becomes like a warm poultice. An advantage with plastic is however that it retains its shape under the influence of moisture and thus always suits the ski bindings. The play between the foot/tibia and the ski shall furthermore be as little as possible which means that the boot must fit properly. Fitting can not be achieved by only pulling tightly about the foot, and the foot must instead be well fitting in the boot and the so-called "bedding modulus" must be high. Good fitting and high bedding modulus is at present achieved in substantially two ways, e.g. with the help of flow or with foam. The use of "flow" in this context means that the shoe is placed in a number of plastic bags containing a viscous compound rather like chewing-gum, and 5–15 minutes after the boot has been put on the foot this flow has adjusted itself to the foot. In this way a perfect fit is obtained even for different feet, socks with folds etc. In this case the bedding modulus will be high for the short loading periods in question.

"Foam" in this context is a plastic bubble preparation which is injected into pouches in the boots and then hardens. If the foot were placed in the boot to begin with, then after injection there will be a moulded impression of it. The fit will be perfect in this case as well, and furthermore heat insulation will be good, but the boot must be "re-foamed" for another person. A drawback with foam is that it does not keep for long and crumbles away.

Further to the flow and foam methods, attempts have also been made to pump up the boots with air in order to make them fit the foot well.

In certain situations it is a great advantage for a skier if he can move his centre of gravity backwards in relation to the skis, especially when skiing on wet deep snow. To enable this "back heaviness", it is usual for the boots to be provided with high heels, but it has been found that it is difficult to utilize the heel effectively if it does not slope forwards rather heavily. It is thus usual for the heel to slope forward so much that the tibia is at an angle of up to 20° from a line at right angles to the plane of the ski. This heavy forward slope results however in the skier, when he is waiting in a ski lift queue, moving with or without skis or is resting, must stand the whole time with bent knees and feet in a very tiring and unnatural position. There is thus a need for a ski boot which can be quickly set from skiing position to resting position. There is further a need of a certain amount of mobility for the tibia in a forward and backward direction, i.e. a springiness in the angle of the tibia, which to a certain extent is met by some of the latest types of ski boot.

A fact to which known ski boots do not take consideration is that some people are bow-legged and others are knock-kneed. This means that certain skiers ski on the outer edges of the skis while others ski on the inner edges. To put this matter right it is usual that the boots are "wedged", i.e. a coin or something similar is taped onto the ski or under the shoe to adjust the sideways angle between the plane of the ski and the foot/tibia. It can however be difficult to achieve the most ideal angle in this way, and furthermore it may also be desirable to alter this angle in relation to the type of skiing to be undertaken, since in icy conditions, for example, it is an advantage to ski on the inner edges of the skis. It is furthermore an advantage if this edge lies more directly under the foot than the other edge, i.e. the rotational axis for this adjustment should be one lying at a distance above the ski. There may furthermore be a need of regulating the sideways position of the foot on top of the ski, even if the above-mentioned position of the rotational axis should give less need for this latter regulation. There is also a known ski boot in which the angle between the tibia and the plane of the ski can be adjusted, but it is not possible to adjust the angle between the foot itself and the plane of the ski.

The present invention has the object of removing the above-mentioned drawbacks burdening known ski boots and is characterized in that the inner shell constituting the foot support of the boot consists of an upper and lower portion made from a stiff material, there being a common pivot between these two portions, while the environmental and climate shield consists of a soft material which can be turned down to expose the inner shell.

According to a preferred embodiment of the ski boot the inner shell is perforated so that the foot can "breathe". According to another preferred embodiment, the lower portion of the inner shell is attached to the sole in such a way that it is pivotable in relation to the sole about an axis mainly in the longitudinal direction of the ski and parallel to the plane of the ski, whereby the angle between the foot/tibia and a normal to the plane of the ski can be adjusted sideways. Furthermore, this axis can be displaced sideways individually at the toe and heel of the foot, and at the heel it can also be adjusted in height. According to still further preferred embodiments of the invention the forward inclination of the upper portion of the inner shell which supports the tibia is adjustable via the joint between both portions, and the boot can also include an adjustable sprung means which is arranged to regulate the freedom of movement of the tibia forwardly, and an adjustable sprung means which is arranged to regulate the freedom of movement of the tibia backwardly. The ski boot according to the invention can further comprise means for releasing the upper portion of the shell so that the joint is completely free in a forward—backward direction between the foot and the tibia. According to a particularly preferred embodiment the inner shell furthermore consists of a moulded impression of the foot, possibly with extra room at tender places.

Among the many advantages which are achieved with the ski boot according to the invention are, inter alia, that the foot can now "breathe", since the inner shell is perforated, that a perfect fit is obtained between the foot and boot with a very high bedding modulus as a result of the inner shell being a moulded impression of the foot, that the forward inclination of the tibia can be adjusted in different positions, that the spring bias for the movement of the tibia backwards and forwards is adjustable and that the angle between the tibia/foot and the normal to the plane of the ski is adjustable sideways. Other aspects of the invention are that the position of the foot on the ski is adjustable sideways, that the heel is adjustable in height as well, and that the boot enables switching to a free forwards—backwards joint between the foot and the tibia, so that amongst other things it would be quite possible to drive a car with the ski boots on.

The ski boot according to the invention is described in detail in the following, while referring to the attached drawing, on which an embodiment of the invention is schematically illustrated as an example.

Figure 1D:
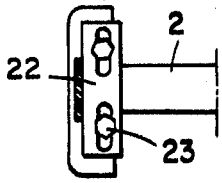
FIG. 1D is a view seen from above of the sole along the line D—D in FIG. 1A.
Figure 1C:
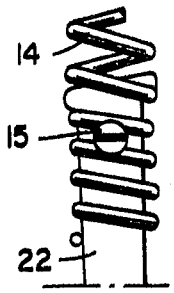
FIG. 1C shows a detail of the spring means along the line C—C in FIG. 1A.
Figure 1B:
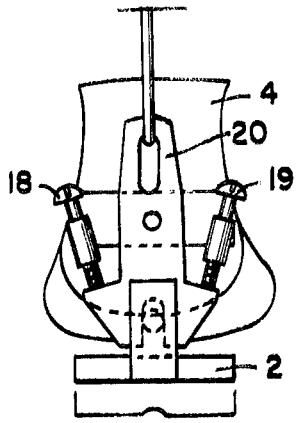
FIG. 1B is a view seen from behind of the boot according to FIG. 1A along the line B—B in the latter figure.
Figure 1A:
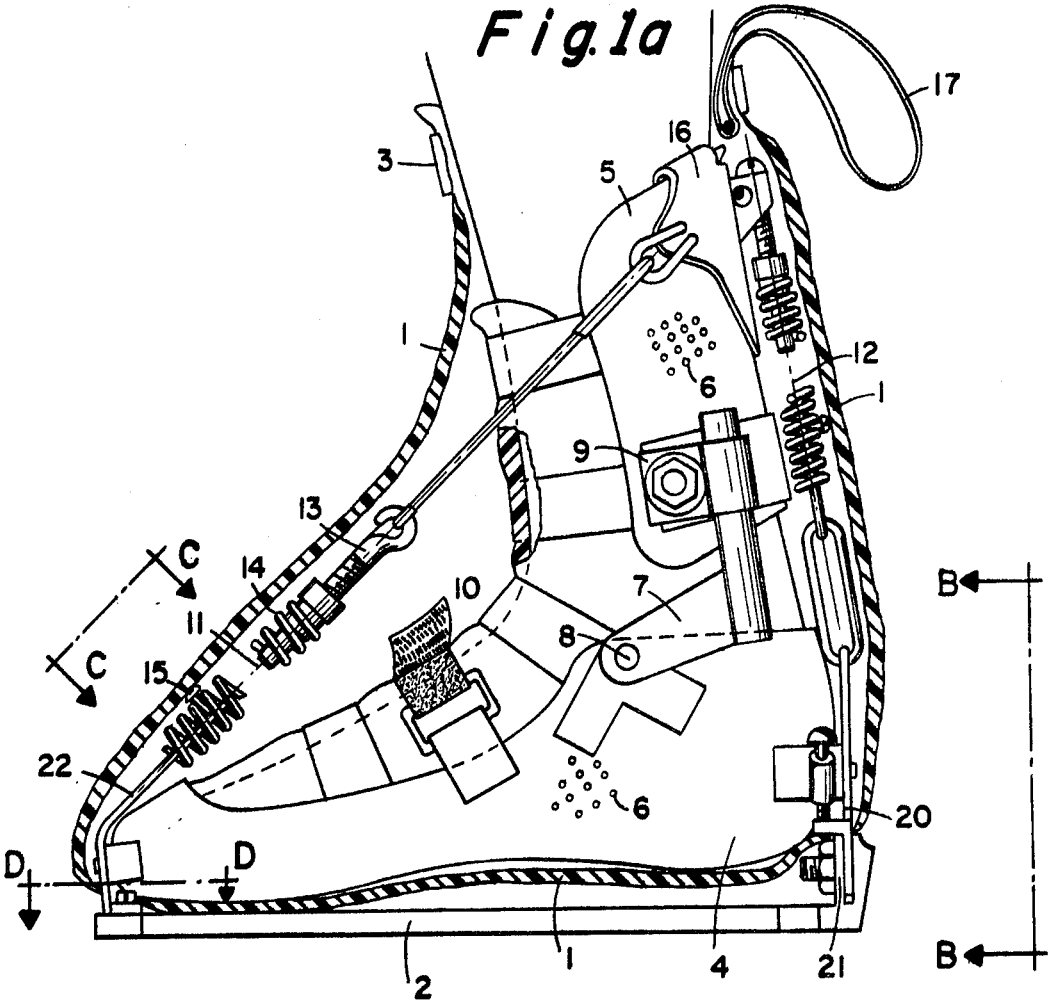
FIG. 1A is a side view of a ski boot according to the invention, the environmental and climate shield being shown in cross-section.

The ski boot shown on the drawing comprises an environmental and climate shield 1, made for instance from a lined bag of some heavy water-repelling material and is drawn up and tied about the leg, e.g. by means of strap 3. The sole 2 suitably consists of rectangular tube, one along the middle of the ski and two or more cross-pieces to give a supporting surface against the ski or other substructure as well as fastening points for the ski bindings. Inside the climate shield 1 and nearest to the foot there is an inner shell consisting of a lower portion 4 about the foot and an upper portion 5 at the back of the lower part of the tibia. Both these parts are moulded foot impressions with extra space at certain tender places, and consist of glass fibre reinforced plastic provided with ventilation perforations 6. The parts 4 and 5 are mutually jointed via one or two links 7, the common joint 8 between the parts being situated substantially in line with the ankle. The position of the upper part 5 in relation to the joint 8 and its inclination in relation to the part 4 are adjustable by a friction joint at the upper end 9 of the link 7. The foot is retained in the shells 4 and 5 with the aid of straps 10.

Between the toe portion of the boot and the rear portion of the upper shell 5 there is a means 11 provided with a spring, the means being adjustable in length and spring bias. By using the adjusting screw 13 the forward—backward angle of the tibia for which force is obtained in the means 11 is adjusted and thereby support against the movement of the tibia backwards. Spring bias is regulated by the spring 14 being screwed more or less onto the part 22 and is fixed by means of the screw 15 to enable a varying amount of the spring 14 to be active. The means 12 functions in a corresponding manner for movement of the tibia forwards.

To enable quick switching of the ski boot from skiing position to resting position there is an unhookable leaf 16 on the upper shell 5, provided with a handle 17 for releasing the upper shell 5 supporting the tibia. The said spring means 11 and 12 are attached to the leaf 16, as apparent from the drawing. At its heel portion the boot includes two screws 18 and 19 with the help of which the foot portion 4 of the shell can be adjusted in relation to the sole 2 for varying sideways inclination. The sideways position of the heel and its height are regulated by the portion 20 being inclined sideways and/or raised or lowered, whereafter it is kept in position by the friction joint 21. The sideways position of the toes is adjusted by moving the portion 22 sideways and thereafter fixing it in position with the screws 23.

In the preceding there has been described a special embodiment of a ski boot according to the invention, but it should be appreciated that the invention is not limited to this special embodiment and may embrace all the embodiments falling within the scope of the patent claims. It should thereby be noted that especially the design of the spring means 11 and 12 can be varied within wide limits in relation to what is shown on the drawing and described in the preceding. Amongst other things they may be given progressive spring bias, i.e. the spring bias increases with increased deformation by allowing the springs, which can be replaced by rubber units, to act via a link system, the geometry of which is altered in proportion to deflection so that the proportion of the resultant force in relation to the force in a spring increases with increased deflection.

What is claimed is:

1. A ski boot for downhill skiing, comprising an inner shell including an upper tibia-supporting section and a unitary lower foot-supporting section, means for pivotably connecting said upper section to said lower section for movement relative thereto about a horizontal pivotal axis, a sole adapted for mounting on a ski and an outer environment and climate shield enclosing said inner shell formed of a relatively soft material foldable downwardly to expose said inner shell, said lower section of the inner shell being attached to the sole in such a way that it is pivotable in relation to the sole about an axis generally in the longitudinal direction of the ski and parallel to the plane of the ski, whereby the angle between the foot/tibia and a normal to the plane of the ski can be adjusted sideways.

2. A ski boot as claimed in claim 1, including adjustable spring means connected between said upper section and the front of said sole for regulating the rearward pivotal movement of said upper section and thereby the forward mobility of the tibia.

3. A ski boot as claimed in claim 1, including adjustable spring means connected between said upper section and the rear of said sole for regulating the forward pivotal movement of said upper section and thereby the backwards mobility of the tibia.

4. A ski boot as claimed in claim 1, including means for releasably connecting said upper and lower inner shell sections whereby upon disconnecting of said sections complete freedom of movement is provided between the foot and the tibia.

5. A ski boot as claimed in claim 1, wherein the inner shell is perforated so that the foot can be ventilated.

6. A ski boot as claimed in claim 1, wherein said lower section of the inner shell is attached to the sole in such a way that it can be displaced sideways and in height in relation to the sole.

7. A ski boot as claimed in claim 1, wherein means are provided for adjusting the forward inclination of said upper section of the shell which supports the tibia, said adjusting means including the means for pivotably connecting said upper and lower inner shell sections.

8. A ski boot as claimed in claim 1, wherein the inner shell consists of a moulded impression of the foot.

9. A ski boot for downhill skiing, comprising an inner shell including an upper tibia-supporting section and a unitary lower foot-supporting section, means for pivotably connecting said upper section to said lower section for movement relative thereto about a horizontal pivotal axis, a sole adapted for mounting on a ski, an outer environment and climate shield enclosing said inner shell formed of a relatively soft material foldable downwardly to expose said inner shell, the lower section of said inner shell being attached to the sole in such manner that it is pivotable relative to the sole about an axis which extends generally longitudinally of the ski parallel to the plane thereof, the angle between the foot and tibia and a plane normal to the plane of the ski being thus adjustable sideways.

10. A ski boot for downhill skiing, comprising an inner shell including an upper tibia-supporting section and a unitary lower foot-supporting section, means for pivotably connecting said upper section to said lower section for movement relative thereto about a horizontal pivotal axis, a sole adapted for mounting on a ski, an outer environment and climate shield enclosing said inner shell formed of a relatively soft material foldable downwardly to expose said inner shell, the lower section of said inner shell being attached to the sole in such manner that it is displaceable sideways and in height relative thereto.

* * * * *